US010532901B2

(12) United States Patent
Lassen

(10) Patent No.: US 10,532,901 B2
(45) Date of Patent: Jan. 14, 2020

(54) DEVICE AND METHOD FOR ALIGNING BLANKS IN A MAGAZINE HOLDING A NUMBER OF BLANKS, AND AN APPARATUS AND METHOD FOR FETCHING A BLANK FROM A MAGAZINE HOLDING A NUMBER OF BLANKS

(71) Applicant: Tetra Laval Holdings & Finance S.A., Pully (CH)

(72) Inventor: Erik Lassen, Sodra Sandby (SE)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 0 days.

(21) Appl. No.: 15/779,460

(22) PCT Filed: Nov. 24, 2016

(86) PCT No.: PCT/EP2016/078720
§ 371 (c)(1),
(2) Date: May 25, 2018

(87) PCT Pub. No.: WO2017/093123
PCT Pub. Date: Jun. 8, 2017

(65) Prior Publication Data

US 2018/0251325 A1 Sep. 6, 2018

(30) Foreign Application Priority Data

Nov. 30, 2015 (SE) ..... 1551555

(51) Int. Cl.
*B65H 3/62* (2006.01)
*B65H 1/02* (2006.01)
*B65H 3/08* (2006.01)

(52) U.S. Cl.
CPC ..... *B65H 3/62* (2013.01); *B65H 1/02* (2013.01); *B65H 3/0808* (2013.01);
(Continued)

(58) Field of Classification Search
CPC ..... B65H 3/62; B65H 9/101; B65H 2301/42342; B65H 2404/722
See application file for complete search history.

(56) References Cited

U.S. PATENT DOCUMENTS 2,626,147 A 1/1953 Gjostein
2,994,253 A 8/1961 Jones
(Continued)

FOREIGN PATENT DOCUMENTS

CN 102156170 A 8/2011
EP 2 815 995 A1 12/2014
(Continued)

OTHER PUBLICATIONS

International Search Report from corresponding PCT Application No. PCT/EP2016/078720 dated Feb. 20, 2017 (3 pages).
(Continued)

*Primary Examiner* — Howard J Sanders
(74) *Attorney, Agent, or Firm* — Finnegan, Henderson, Farabow, Garrett & Dunner, LLP

(57) ABSTRACT

The invention relates to a device (1) and method for aligning blanks (2) in a magazine (3) holding a number of blanks (2), each blank (2) being a sleeve shaped piece of packaging material folded planar. The device (1) comprises a plate element (4), and a vibrating means (5) connected to said plate element (4) to vibrate said plate element (4) in relation to said magazine (3), such that said plate element (4) comes into contact with an edge of any unaligned blanks in said magazine in order to align said unaligned blanks. The invention also relates to an apparatus (100) and method for fetching a blank (2) from a magazine (3) holding a number of blanks (2).

13 Claims, 2 Drawing Sheets

(52) U.S. Cl.
CPC ..... *B65H 2301/42342* (2013.01); *B65H 2404/722* (2013.01); *B65H 2701/1766* (2013.01)

(56) References Cited

U.S. PATENT DOCUMENTS 3,242,827 A 3/1966 Winters
5,067,937 A * 11/1991 Aschaber ..... B31B 50/80 493/310
5,890,713 A * 4/1999 Hofmann ..... B65H 31/38 271/221

FOREIGN PATENT DOCUMENTS

WO WO 2008-124117 A1 10/2008
WO WO 2015-091977 A1 6/2015

OTHER PUBLICATIONS

Office Action from corresponding Swedish Application No. 1551555-4 dated Jun. 21. 2016 (7 pages).

* cited by examiner

DEVICE AND METHOD FOR ALIGNING BLANKS IN A MAGAZINE HOLDING A NUMBER OF BLANKS, AND AN APPARATUS AND METHOD FOR FETCHING A BLANK FROM A MAGAZINE HOLDING A NUMBER OF BLANKS

CROSS-REFERENCE TO RELATED PATENT APPLICATIONS

This is a National Phase of International Application No. PCT/EP2016/078720, filed Nov. 24, 2016, which claims the benefit of Swedish Application No. 1551555-4 filed Nov. 30, 2015. The entire contents of the above-referenced applications are expressly incorporated herein by reference.

TECHNICAL FIELD

The present invention relates a device and method for aligning blanks in a magazine holding a number of blanks, and an apparatus and method for fetching a blank from a magazine holding a number of blanks.

BACKGROUND ART

In the field of carton based packaging for liquid food products, there are generally two main types of systems; roll fed systems and blanks fed systems. An example of roll fed systems is Tetra Brik™ marketed by Tetra Pak, and an example of blanks fed systems is Tetra Recart™ or Tetra Rex™, both marketed by Tetra Pak.

In the roll fed systems, a roll of packaging material is fed to the system. The roll is shaped into a tube, which in turn is filled with a liquid food product. By successively making transversal sealings in the lower part of the tube and cutting of the lower part of the tube packages can be formed.

In the carton blanks fed systems, the packaging material is prepared before being fed to the system by cutting this into pieces, wherein each piece corresponds to one package, and by providing a longitudinal sealing such that each piece is shaped into a sleeve-shaped body. In order to facilitate folding, weakening lines may be provided in the packaging material. The sleeve shaped packaging material pieces are usually referred to as blanks.

In the filling machine these are placed in a magazine, usually in an upright position such that the openings are placed vertically. According to one way of operating a blanks fed system, a blank is fetched from the magazine, erected and placed in a cassette providing for that blank is kept in a position such that a sleeve with a rectangular cross section is formed. Thereafter, one end of the sleeve is closed and sealed such that a package with an open end is formed. Next, the package is filled with a liquid product via the open end, and finally the open end of the package is sealed and closed.

Usually the blanks are produced at one site, sometimes referred to as a converting factory, and transported to another site where the filling system is placed. During the transportation there is a risk that the blanks are squeezed together such that inner sides of the blanks stick to each other and that close lying blanks stick to each other. Another problem that might occur when the blanks are loaded into a magazine is that they end up unaligned and thus risk getting entangled with each other or with other components in the machine. Therefore, faced with this reality, it is a challenge to make sure that the blanks can be fetched from the magazine at high speeds, i.e. fetching more than one blank per second, and in a robust way, i.e. causing few unwanted interruptions.

SUMMARY OF THE INVENTION

It is an object of the present invention to mitigate, alleviate or eliminate one or more of the above-identified deficiencies in the art and disadvantages singly or in any combination and solves at least the above mentioned problems.

According to a first aspect, these and other objects are achieved in full, or at least in part, by a device and for aligning blanks in a magazine holding a number of blanks, wherein each blank is a sleeve shaped piece of packaging material folded planar. The device comprises a plate element, and a vibrating means connected to said plate element to vibrate said plate element in relation to said magazine, such that said plate element comes into contact with an edge of any unaligned blanks in said magazine in order to align said unaligned blanks. When the plate element comes into contact with the blanks, any potentially unaligned blanks in the magazine will be aligned, and if the blanks have gotten stuck to each other, they will be separated by the small force applied on the blanks by means of the plate element.

The plate element and/or the vibrating means may be resiliently suspended in relation to the magazine, for example by means of a spring means. The spring means may in turn comprise any one from the group consisting of a spring, a spring plate, a rubber band, a spring wire, wire connected to a spring, and a roll of spring-loaded coiled wire.

The vibrating means may be suspended in two parallel spring plates, located at a distance from each other, to allow movement in only one direction, and may comprise an air driven vibrator.

The vibration direction of the plate element may be perpendicular to a normal direction of the blanks.

According to a second aspect, the objects are achieved in full, or at least in part, by an apparatus for fetching a blank from a magazine holding a number of blanks. The apparatus comprises a rotary feeder provided with a gripper. The rotary feeder and the gripper are arranged to rotate around a main rotational axis, such that the gripper is moved between a fetching position in which a blank is fetched and a releasing position in which the blank is released. The gripper is arranged to rotate around a gripper specific rotational axis, such that fetching said blank in the fetching position is facilitated. The apparatus also comprises at least one device for aligning the blanks in the magazine as described above.

A gripper cam curve may be provided for controlling rotation of said gripper around said gripper rotational axis when said rotary feeder is rotated around said main rotational axis.

The gripper may comprise a gripper head, wherein said gripper head is arranged to rotate around a gripper head specific rotational axis.

According to a third aspect, the objects are achieved in full, or at least in part, by a method for aligning blanks in a magazine holding a number of blanks by means of an alignment device, the device comprising a plate element, and a vibrating means connected to the plate element. The method comprises the step of vibrating the plate element in relation to the magazine by means of the vibrating means, such that the plate element comes into contact with an edge of any unaligned blanks in the magazine in order to align the unaligned blanks.

According to a fourth aspect, the objects are achieved in full, or at least in part, by a method for fetching a blank from a magazine holding a number of blanks, each of the blanks being a sleeve shaped piece of packaging material folded planar. The method comprises the steps of rotating a rotary feeder provided with a gripper around a main rotational axis, such that the gripper is moved between a fetching position in which the blank is fetched and a releasing position in which the blank is released, rotating the gripper around a gripper specific rotational axis, such that fetching the blank in the fetching position is facilitated, and vibrating a plate element in relation to the magazine by means of a vibrating means, such that the plate element comes into contact with an edge of any unaligned blanks in the magazine in order to align the unaligned blanks.

Generally, all terms used in the claims are to be interpreted according to their ordinary meaning in the technical field, unless explicitly defined otherwise herein. All references to "a/an/the [element, device, component, means, step, etc.]" are to be interpreted openly as referring to at least one instance of the element, device, component, means, step, etc., unless explicitly stated otherwise.

BRIEF DESCRIPTION OF THE DRAWINGS

The above objects, as well as additional objects, features and advantages of the present invention, will be more fully appreciated by reference to the following illustrative and non-limiting detailed description of preferred embodiments of the present invention, when taken in conjunction with the accompanying drawings, wherein.

DETAILED DESCRIPTION OF PREFERRED EMBODIMENTS OF THE INVENTION

Figure 1:
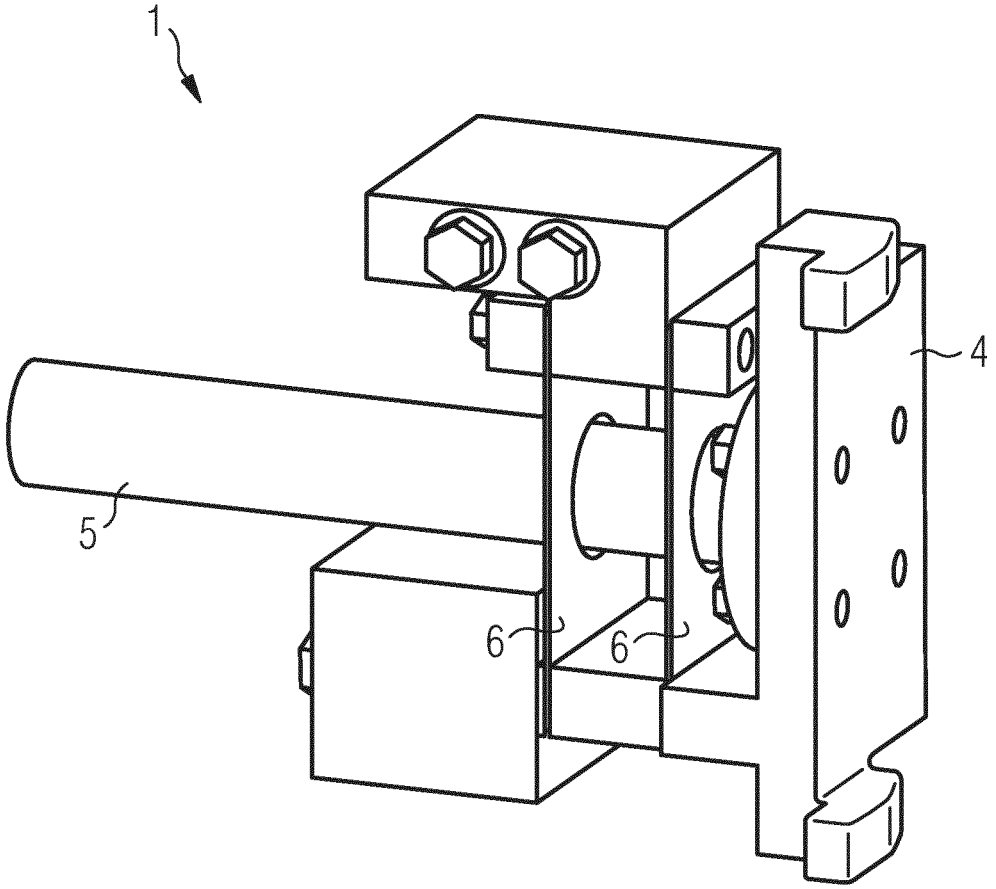
FIG. 1 is a perspective view of an exemplary embodiment of a device for aligning blanks in a magazine according to a first aspect of the present invention.

FIG. 1 illustrates a device 1 for aligning blanks 2 in a magazine 3 holding a number of blanks 2. Each blank 2 is comprised of a sleeve shaped piece of packaging material which has been folded planar. The device 1 comprises a plate element 4 and a vibrating means 5. The vibrating means 5 may be an air driven vibrator and is suspended in two parallel spring plates 6, located at a distance from each other, to allow movement in only one direction. The vibrating means 5 is connected to the plate element 4 in order to vibrate the plate element 4 in relation to the magazine 3. The vibration direction of the plate element 4 is perpendicular to a normal direction of the blanks 2. This way, the plate element 4 will come into contact with an edge, side edge, of any potentially unaligned blanks in the magazine 3 and thereby align the same. Thus, the unaligned blanks 2 are aligned with the rest of the blanks 2, by the plate element 4 pushing on the edge of the unaligned blank 2 when the plate element 4 is vibrated against the unaligned blank 2. The plate element 4 is therefore configured to move a distance forward to the blanks 2 and then back for aligning the unaligned blanks 2.

Figure 2:
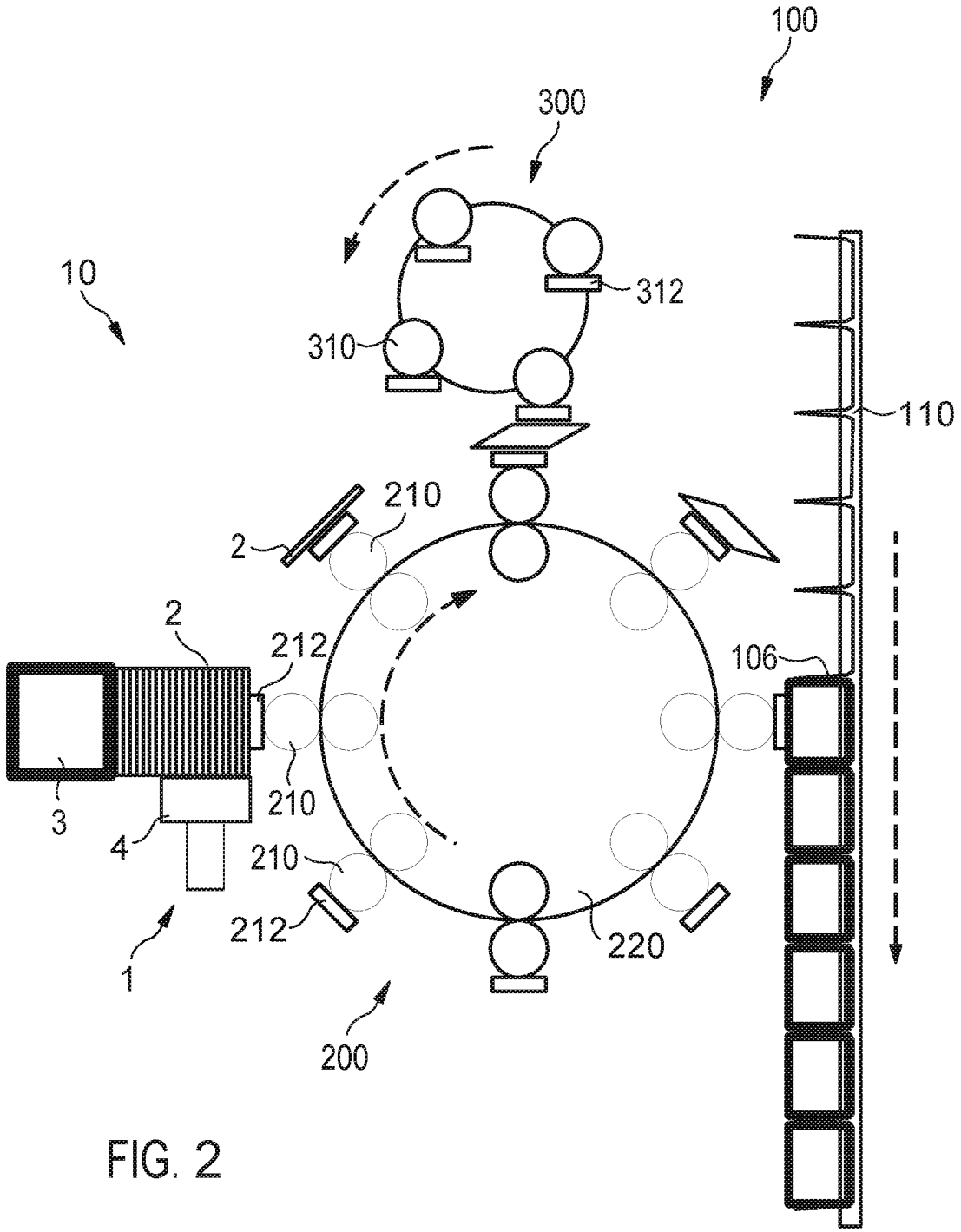
FIG. 2 is a schematic view of an exemplary embodiment of an apparatus for fetching a blank from a magazine according to a second aspect of the present invention.

FIG. 2 illustrates an apparatus 100 for fetching a blank 2 from a magazine 3 holding a number of blanks 2. The infeed apparatus 100 may form part of a larger plant 10, such as a filling system for packaging of food into individual packages, such as carton based packages.

The main purpose of the rotary infeed apparatus 100 is to transport folded package blanks 2 from a magazine 3, or supply, to individual carriers 106. Once positioned in a carrier 106, the blank 2 is partly sealed in order to form a semi-finished package, whereafter it is filled with a product before sealing the end being still open. Hence, the rotary infeed system 100 may preferably be arranged upstream, or before a first sealing unit, a filling unit, and a second sealing unit. Additional equipment of the filling system 10 may e.g. include various distribution units, batch autoclaves, and transporting and packing units.

The main components of the rotary infeed apparatus 100 are the magazine 3, a rotary feeder 200, optionally a carousel 300, and a stream of individual carriers 106.

As previously mentioned, the magazine 3 stores a plurality of stacked blanks 2. Each blank 2 forms a box-like structure having open ends, however it is folded such that a planar body is provided. By operating the infeed apparatus 100 the folded blank 2 is fetched from the magazine 3 and released into the carrier 106. The rotary infeed apparatus 100 also provides a shape adjustment, such that the carrier accommodates an open-ended box-like package.

During the transportation there is a risk that the blanks 2 are squeezed together such that inner sides of the blanks 2 stick to each other and that close lying blanks stick to each other. Another problem that might occur when the blanks are loaded into the magazine 3 is that they end up unaligned and thus risk getting entangled with each other or with other components in the apparatus 100. To alleviate these problems, the apparatus 100 is provided with the device 1 as described above.

Transport from the magazine 2 and forming is achieved by a rotary feeder 200 in cooperation with a carousel 300. For this, the rotary feeder 200 has a driving unit 220 which provides a rotational movement of the feeder 200. At least one gripper 210 is arranged at the outer periphery of the feeder 200 and includes one or more suction cups 212 which are securing the blank 2 to the gripper 210 when suction is applied, through connection to a vacuum source. Hence, by removing the suction the gripper 210 will release the article, or semi-finished package, to a carrier.

As illustrated in FIG. 2 the gripper 210 can engage with the blank 2 at the position of the magazine 3, whereby the gripper 210 removes the blank 2 from the magazine 3 as the feeder 200 rotates. Somewhere between the receiving position, i.e. the position when the gripper 210 faces the magazine 3, and the release position, i.e. the position when the gripper 210 faces the carriers 106, the carousel 300 is arranged. The carousel 300 can be provided with secondary grippers 310, also being provided with one or more suction cups 312. The position of the carousel 300 can be provided such that the secondary gripper 310 will be allowed to engage with the blank 2 being carried by the gripper 210 of the feeder 200. Due to a difference in relative motion between the gripper 210 of the feeder 200 and the secondary gripper 310 of the carousel 300 the blank 2 will be forced to adapt its shape, as is indicated in FIG. 2. Pre-made creasing lines in the blank 2 can facilitate proper shape adjustment of the blank 2.

The secondary gripper 310 can be controlled to release the suction force at a predetermined position, such that the gripper 210 of the feeder 200 can continue to transport the blank 2 towards the carriers 106. During this movement the shape of the blank 2 will be substantially the same as when the secondary gripper 310 releases the blank 2, although some flexibility of the blank 2 may be provided.

The carriers 106 can be transported by a conveyor 110 to and from the release position of the feeder 200, such that the blank 2 may be released in an empty carrier by releasing the suction from the suction cups 212 of the gripper 210.

In order to operate the infeed unit 100 at high speed it is desirable that the movements of the blanks 2 are extremely accurate in terms of position and angle relative the cooperating components, i.e. the magazine 3, the carousel 300, and the carriers 106. The rotary feeder 200 can allow for secure separation and erecting of carton based packages more or less independent of the shape and friction of the blank material. Further to this, the rotary feeder 200 can allow for preparation of the blank 2 in order to ensure proper opening, forming, and sealing of the package. Additional advantages include increased robustness, a reduced number of components, designed for high speed applications, reduced cost, increased hygiene, as well as improved visibility.

One idea of the rotary feeder 200 is to provide two cams, or guiding tracks, making it possible to locally influence the speed and angle of the suction cups 212 of the grippers 210 independently of each other at all positions during a revolution. This makes it possible to adjust the movements so in full speed the suction cups 212 will make a non-rotating linear movement without sliding against counter surfaces. It is further possible to control the angle of the suction cups 212 in an optimal manner. The provision of the two guiding tracks further allows for speed and angle adjustment so as to have a synchronized or customized movement of the grippers 210 for a certain time relative other components, allowing for proper pre-opening and release of the blank 2.

It is understood that other variations in the present invention are contemplated and in some instances, some features of the invention can be employed without a corresponding use of other features. Accordingly, it is appropriate that the appended claims be construed broadly in a manner consistent with the scope of the invention.

The invention claimed is:

1. A device configured to align blanks held in a magazine, each blank being a folded piece of packaging material, the device comprising:

a plate element configured to contact a respective edge of an unaligned blank in the magazine; and a vibrating element connected to the plate element and configured to vibrate the plate element relative to the magazine, wherein when the vibrating element vibrates the plate element, the plate element is configured to contact the respective edge of the unaligned blank to thereby align the unaligned blank with the other blanks held in the magazine, and wherein the vibrating element is configured to extend at least partially within an opening formed in at least one of two parallel spring plates, the parallel spring plates being located at a distance from each other, wherein the parallel spring plates are configured to allow movement of the vibrating element along a single axis.

2. The device according to claim 1, wherein at least one of the plate element or the vibrating element is resiliently suspended relative to the magazine.

3. The device according to claim 2, further including:

a spring unit configured to resiliently suspend the at least one of the plate element or the vibrating element.

4. The device according to claim 3, wherein the spring unit comprises a spring plate.

5. The device according to claim 1, wherein the vibrating element comprises an air driven vibrator.

6. The device according to claim 1, wherein a vibration direction of the plate element is perpendicular to a normal direction of the blanks held in the magazine.

7. An apparatus including the device according to claim 1 and configured to remove a respective blank from the magazine, the apparatus comprising:

a gripper configured to move between a fetching position, in which the gripper is configured to grip the respective blank and remove the respective blank from the magazine, and a releasing position, in which the gripper is configured to release the respective blank; and a rotary feeder configured to rotate the gripper about a main rotational axis between the fetching position and the releasing position.

8. The apparatus according to claim 7, further comprising a second device configured to adjust a shape of at least one blank from the magazine while the at least one blank is engaged by the gripper.

9. The apparatus according to claim 7, wherein the gripper is configured to rotate around a gripper rotational axis while the rotary feeder rotates around the main rotational axis.

10. The apparatus according to claim 7, wherein the gripper comprises at least one suction device configured to rotate relative to the gripper.

11. The device according to claim 7, further comprising:

a secondary gripper mounted on a secondary rotary feeder, the secondary rotary feeder configured for rotation about a secondary rotational axis independent of the rotation of the rotary feeder about the main rotational axis, wherein the gripper and secondary gripper are configured such that relative motion between the gripper and the secondary gripper adjusts the shape of at least one folded blank.

12. A filling machine comprising the device according to claim 1 for aligning blanks.

13. A method of aligning blanks in a magazine with an alignment device, the magazine holding a plurality of blanks, wherein the alignment device comprises a plate element and a vibrating element connected to the plate element, the method comprising:

activating the vibrating element to vibrate the plate element relative to the magazine; and contacting a respective edge of at least one unaligned blank in the magazine with the vibrating plate element, wherein the contacting aligns the unaligned blank with the other blanks held in the magazine, and wherein the vibrating element extends at least partially within an opening formed in at least one of two parallel spring plates such that the vibrating element moves along a single axis while the vibrating element is activated.

* * * * *